US009890798B2

(12) United States Patent
Oda et al.

(10) Patent No.: US 9,890,798 B2
(45) Date of Patent: Feb. 13, 2018

(54) AXIAL FAN

(71) Applicant: MINEBEA CO., LTD., Kitasaku-gun, Nagano (JP)

(72) Inventors: Yusuke Oda, Yokohama (JP); Tomoko Nonaka, Hamamatsu (JP); Masaaki Nishizawa, Kitasaku-gun (JP); Shinichi Uchikawa, Kitasaku-gun (JP)

(73) Assignee: MINEBEA CO., LTD., Kitasaku-gun (JP)

( * ) Notice: Subject to any disclaimer, the term of this patent is extended or adjusted under 35 U.S.C. 154(b) by 470 days.

(21) Appl. No.: 14/063,674

(22) Filed: Oct. 25, 2013

(65) Prior Publication Data

US 2014/0186198 A1 Jul. 3, 2014

(30) Foreign Application Priority Data

Dec. 27, 2012 (JP) ..... 2012-285998

(51) Int. Cl.

| | |
|---|---|
| ***F03D 11/00*** | (2006.01) |
| ***F04D 29/66*** | (2006.01) |
| ***F04D 25/06*** | (2006.01) |
| ***F04D 29/52*** | (2006.01) |

(52) U.S. Cl.
CPC ..... *F04D 29/668* (2013.01); *F04D 25/0613* (2013.01); *F04D 29/522* (2013.01)

(58) Field of Classification Search
CPC .. F05B 2260/96; F04D 29/663; F04D 29/668; F04D 29/522; F04D 29/665; F04D 25/0613; F05D 2260/96
USPC ..... 415/119, 220, 211; 361/695
See application file for complete search history.

(56) References Cited

U.S. PATENT DOCUMENTS

D483,109 S * 12/2003 Chang ..... D23/411
6,808,411 B2 * 10/2004 Chen ..... F04D 29/601 361/695
7,126,821 B2 * 10/2006 Patel ..... H05K 7/20172 361/679.48
7,275,911 B2 * 10/2007 Lee ..... F04D 25/0613 415/211.2

(Continued)

FOREIGN PATENT DOCUMENTS

JP S60-143198 U 9/1985
JP H08-223863 A 8/1996

(Continued)

OTHER PUBLICATIONS

Aug. 2, 2016 Office Action issued in Japanese Patent Application No. 2012-285998.

*Primary Examiner* — Jason Shanske
*Assistant Examiner* — Jason Mikus
(74) *Attorney, Agent, or Firm* — Oliff PLC

(57) ABSTRACT

There is provided with an axial fan comprising an impeller having a plurality of vanes; a motor rotating the impeller; a casing housing the impeller and the motor; a motor base mounting the motor; and a plurality of spokes connecting the motor base and the casing, wherein the motor base has a plurality of reinforcement ribs thereon, the plurality of reinforcement ribs being equal to or more than the plurality of spokes in number, and wherein the casing has a natural frequency equal to or higher than a frequency being transmitted to the casing from the motor when the motor is rotated at a rotation speed of 20000 rpm or more.

20 Claims, 4 Drawing Sheets

(56) References Cited

U.S. PATENT DOCUMENTS

| | | | | |
|---|---|---|---|---|
| 7,329,091 | B2 * | 2/2008 | Yan | F04D 29/544 415/191 |
| 7,344,358 | B2 * | 3/2008 | Lu | F01D 1/00 415/211.2 |
| 8,133,022 | B2 * | 3/2012 | Yoshida | F04D 25/0613 415/220 |
| 2006/0002790 | A1 * | 1/2006 | Lu | F01D 1/00 415/220 |
| 2008/0292453 | A1 | 11/2008 | Hsu et al. | |
| 2009/0027853 | A1 * | 1/2009 | Simofi-Ilyes | F04D 25/066 361/695 |

FOREIGN PATENT DOCUMENTS

| | | |
|---|---|---|
| JP | A-2006-57631 | 3/2006 |
| JP | 2012184748 A | 9/2012 |

* cited by examiner

AXIAL FAN

TECHNICAL FIELD

The present invention relates to a axial fan. More specifically, the present invention relates to a axial fan used for cooling inside of a device such as an electronic device, and the like.

BACKGROUND ART

In general, a axial fan comprises a casing having a cavity portion in the center, an impeller having a plurality of vanes which rotates together with a rotation axis, a motor for rotating the rotation axis, a motor base for holding the motor. The impeller, the motor and the motor base are housed in the cavity portion of the casing.

A boss is formed integrally with the motor base. A bearing housing of a hollow cylindrical shape provided with a bearing for supporting the rotation axis in the center is fitted and mounted to the boss. A stator of the motor is mounted on the outside of the bearing part, and the rotation axis is mounted inside thereof, rotatably through a bearing. In addition, the motor base is connected to the casing by a plurality of spokes.

Then, when the motor is driven, the rotation axis rotates together with the impeller. By the rotation of the impeller, fluid (air) is sucked into the impeller through one end side of the cavity portion of the casing, or a suction port, and passes through the inside of the casing, and is blown out to the outside of the casing through the other end side of the cavity portion of the casing, or a discharge port. At this time, when it is required to increase the pressure of the fluid blown out to the outside of the casing, a fixed vane is provided in the vicinity of the discharge port of the casing in some case, and the spoke serves as the fixed vane in another case. In addition, the casing, the motor base, and the spoke are formed by molding integrally using a resin or a metal, and the like.

Meanwhile, the axial fan as described above is used to cool an electronic device, by mounting the axial fan to the electronic device and efficiently discharging the heat generated from an electronic component inside the electronic device to the outside of the electronic device. Therefore, high air volume of the axial fan (high blowing out air volume per unit time of the axial fan) is required. In addition, with regard to electronic devices such as a server and the like, the interior space in which the air flows grows smaller and smaller, due to the high density packaging inside the housing. Incidentally, high static pressure (high power of the axial fan for blowing out the air) is required in addition to the above mentioned high air volume to the axial fan for cooling the inside of the housing.

In order to obtain the high air volume and the high static pressure of the axial fan, it is necessary to rotate the motor for rotating the impeller at a high speed. However, when the motor is rotated at a high speed, vibration caused by the high speed rotation of the motor is transmitted to the casing through a bearing, and the vibration is transmitted to the electronic device equipped with the axial fan, there generates a problem that the vibration may occur to the electronic device. In particular, when the vibration caused by the rotation of the motor resonates with the natural frequency of the casing, the vibration grows larger, and, as a result, there may generate a big problem that an abnormal vibration occurs in the electronic device.

With regard to such problems, a axial fan so as to suppress the generation of the vibration, by strengthening the structure of the housing through forming a plurality of reinforcement ribs to the motor base is proposed, as described in Japanese Laid-Open Patent Application Publication No. 2006-57631, for example.

CITATION LIST

Patent Literature

Patent Literature 1: Japanese Laid-Open Patent Application Publication No. 2006-57631

SUMMARY OF INVENTION

Technical Problem

However, although the technology described in Japanese Laid-Open Patent Application Publication No. 2006-57631 proposes a axial fan having a housing structure strengthened by forming a plurality of reinforcement ribs to the motor base, the shape and the structure of the plurality of reinforcement ribs formed on the motor base are not fully disclosed. In addition, in an electronic device such as a server and the like, the axial fan is rotated at 20000 rpm at the maximum rotation speed, by performing a high density packaging inside the housing. If the axial fan is rotated at such a high speed, there generates a problem that the vibration transmitted to the casing through the motor base cannot be necessarily reduced sufficiently.

Accordingly, the present invention has been made in view of the above described problems. It is an object of the present invention to provide a axial fan which enables to reduce the effect of the vibration transmitted to the casing through the motor base, by optimizing the shape and the arrangement of the reinforcement ribs formed on the motor base, even when the maximum rotation speed of the axial fan is increased to the vicinity of 20000 rpm.

Solution to Problem

The present invention has been proposed to achieve the above described object. In accordance with an aspect of the present invention, a axial fan of the present invention comprises: an impeller having a plurality of vanes; a motor rotating the impeller; a casing housing the impeller and the motor; a motor base mounting the motor; a plurality of spokes connecting the motor base and the casing, wherein the motor base has a plurality of reinforcement ribs thereon, the plurality of reinforcement ribs being equal to or more than the plurality of spokes in number, and wherein the casing has a natural frequency equal to or higher than a frequency being transmitted to the casing from the motor when the motor is rotated at a rotation speed of 20000 rpm or more.

Preferably, the plurality of spokes comprises at least seven spokes.

Preferably, each of the plurality of spokes is inclined at a predetermined angle with regard to a plane perpendicular to a rotation axis rotating integrally with the impeller.

Preferably, the axial fan further comprises a hollow boss protrusively disposed around a center of the motor base, wherein each of the plurality of reinforcement ribs is formed in an equal width with extending distance from an outer periphery side of the boss to an outer periphery side of the motor base.

Preferably, the axial fan further comprises a hollow boss protrusively disposed around a center of the motor base, wherein each of the plurality of reinforcement ribs is formed in a gradually decreasing width with extending distance from an outer periphery side of the boss to an outer periphery side of the motor base.

Preferably, each of the plurality of reinforcement ribs is formed extending toward a connecting portion of each spoke and the motor base when the reinforcement ribs are equal to the spokes in number.

Advantageous Effects of Invention

According to the present invention, a axial fan being free from abnormal vibration can be provided, even in a case the axial fan rotates at a maximum rotation speed up to 20000 rpm.

DESCRIPTION OF EMBODIMENTS

Hereinafter, a preferred embodiment for carrying out the present invention (hereinafter referred to as "embodiment") will be described in detail, with reference to the accompanying drawings. Hereinafter, in the following description, an expression indicating a vertical direction is no absolute. It is appropriate if the expression represents a posture in which respective part of the axial fan of the present invention is depicted, but the posture is changed, the expression should be construed in response to the changes of the posture.

Figure 1:
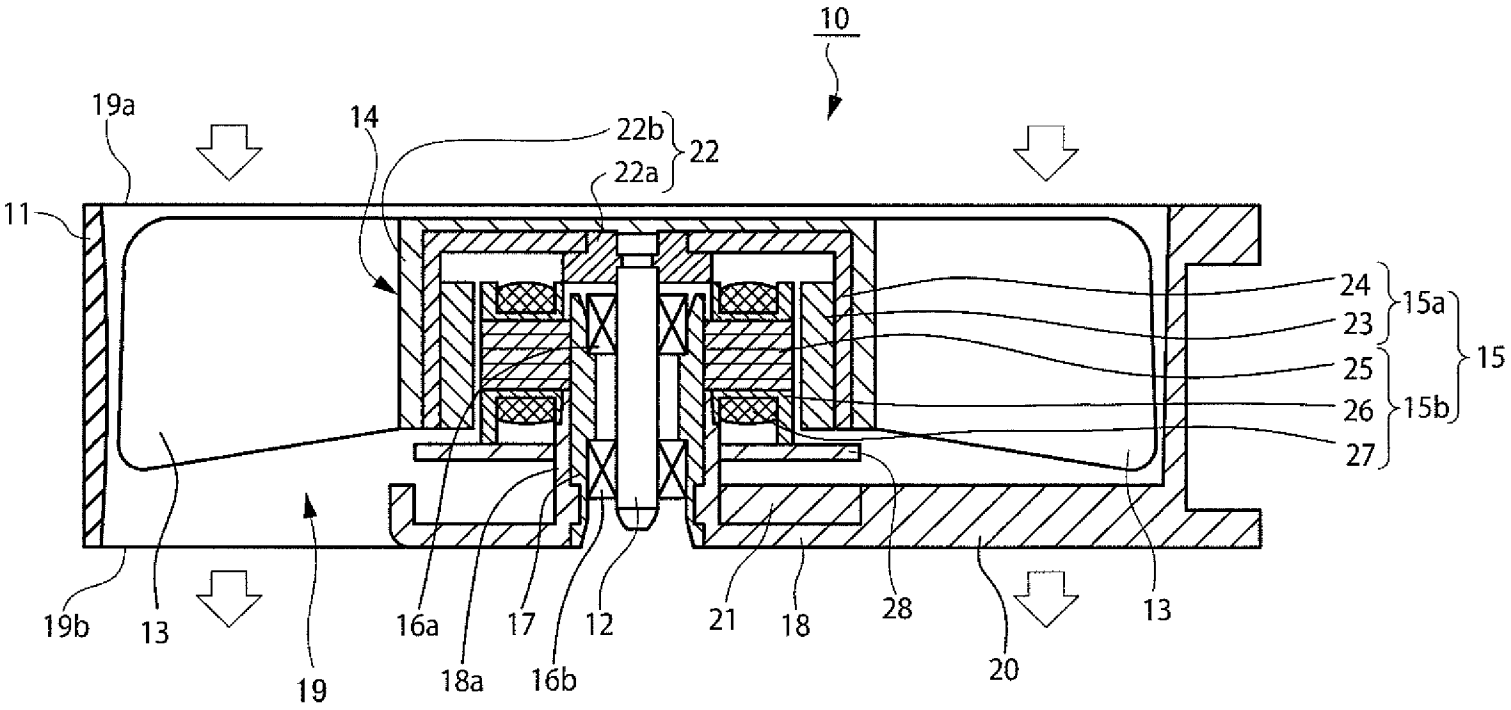
FIG. 1 is a cross-sectional view of a axial fan shown as one embodiment of the present invention.

As shown in FIG. 1, a axial fan 10 according to one example of the embodiment of the present invention is an axial flow fan and comprises, a casing 11, a rotation axis 12, an impeller 14 having a plurality of vanes 13 and rotating integrally with the rotation axis 12, a motor 15 for rotating the rotation axis 12, a hollow cylindrical shape bearing housing 17 being mounted with a vertical pair of bearings 16*a*, 16*b* for supporting the rotation axis 12, a motor base 18 having a boss 18*a* for supporting the bearing housing 17, and the like. The rotation axis 12, the impeller 14, the motor 15, the bearing housing 17 and the motor base 18 are housed in the casing 11.

Figure 2:
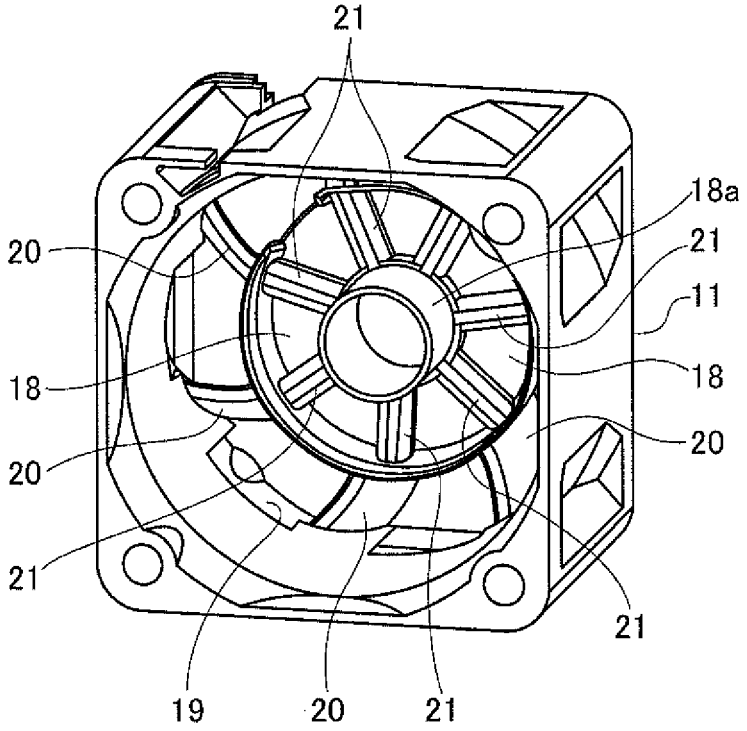
FIG. 2 is a perspective view showing a casing of the axial fan shown in FIG. 1.

In more detail, as shown in FIG. 1 to FIG. 3, the casing 11 is formed in a rectangular shaped frame in a plan view in which a circular shaped cavity portion 19 for ventilation penetrating back and forth is provided in the center portion. In addition, a motor base 18 is disposed at the center of the cavity portion 19, and the inner periphery of the cavity portion 19 and the outer periphery of the motor base 18 are connected by a plurality of spokes 20 (seven in Example 1), and the motor base 18 and the plurality of spokes 20 are integrally molded using a resin. Further, as shown in FIG. 1, at the upper and the lower ends of the cavity portion 19, a suction port 19*a* and a discharge port 19*b* are formed in turn.

Figure 3A:
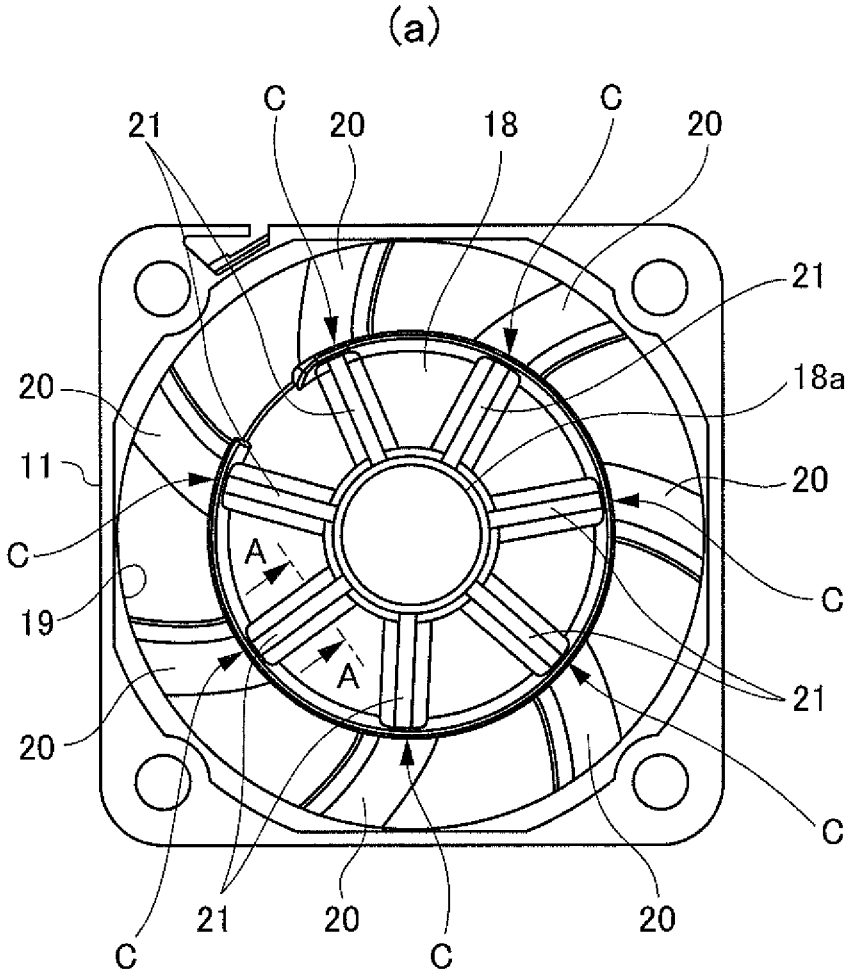
FIG. 3A is a plan view showing the casting of FIG. 2.

As shown in FIG. 1, the plurality of spokes 20 are disposed on the side of the discharge port 19*b* of the casing 11. Further, as shown in FIG. 3A, each of the plurality of spokes 20 is formed radially toward the inner periphery surface of the cavity portion 19 from the outer periphery surface of the motor part base 18, at an equal angle in the circumferential direction. Each of the plurality of spokes 20 increases the pressure of the air blown to the outside of the casing 11, and also acts as a fixed vane because each of the plurality of spokes 20 is inclined at a predetermined angle with regard to a plane perpendicular to the rotation axis 12 so as to rectify the exhaled air.

The motor base 18, which is supported to the casing 11 by the plurality of spokes 20, is provided on the side of the discharge port 19*b* of the casing 11 together with the plurality of spokes 20. In addition, as shown in FIG. 2 and FIG. 3, the motor base 18 is provided integrally with a hollow cylindrical shape boss 18*a* which protrudes toward the side of the suction port 19*a* at the center, and is formed in a disk shape in a plan view. One end of the bearing housing 17 is inserted into the boss 18*a* and is fixedly attached concentrically. An adhesive is used to secure the bearing housing 17.

Figure 3B:
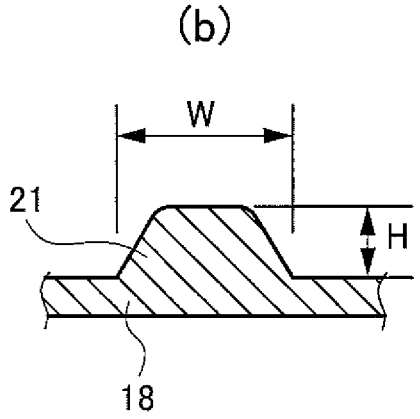
FIG. 3B is an enlarged cross-sectional view taken along line A-A of FIG. 3A.

Further, on the surface of the motor base 18 where the boss 18*a* protrudes, that is, on the surface facing the suction port 19*a*, corresponding to each of the plurality of spokes 20, a plurality of reinforcement ribs 21 (seven in Example 1) extending radially in the outer circumferential direction of the motor base 18, and toward a connecting portion C of the motor base 18 and the plurality of spokes 20, from the outer periphery surface of the boss 18*a*. As shown in FIG. 3B as a cross-section along line A-A of FIG. 3A, each of the plurality of reinforcement ribs 21 protrudes in a mountain like cross-sectional shape, outward from the rear surface of the motor base 18, and is formed integrally with the motor base 18. In addition, without limited to the shape shown in FIG. 3B, the cross-sectional shape of each of the plurality of reinforcement ribs 21 may be formed triangle, square, trapezoidal and the like, otherwise.

As shown in FIG. 3A and FIG. 3B, each of the plurality of reinforcement ribs 21 is formed at an angle equal in the circumferential direction, and also in a same shape, and in a same width (in the circumferential direction) W and a same height (in the axial direction) H over the portion between the outer periphery surface of the boss 18*a* and the connecting portion C. Then, by providing the plurality of reinforcement rib 21 in this way, the strength of the connecting portion C is increased, and at the same time, the overall casing 11 can be strengthened. As described later in detail, when the motor 15 is rotated at a rotation speed of 20000 rpm, the natural frequency of the casing 11 is set so as to be equal to or higher than a frequency being transmitted to the casing from the rotation of the motor.

In addition, the casing 11, the motor base 18, the plurality of spokes 20 and the plurality of reinforcement ribs 21 are integrally molded using a resin, but they can be integrally molded using a metal and the like. Further, the bearing housing 17 can be resin molded integrally with the boss 18*a* of the motor base 18

As shown in FIG. 1, the rotation axis 12 penetrates vertically a pair of bearings 16*a*, 16*b* mounted to the inner periphery of the bearing housing 17, and is secured rotatably. The impeller 14 is integrally attached to the upper end of the rotation axis 12.

Meanwhile, although the bearing housing 17 is described as a separate part in the present embodiment, it can be integral with the boss 18*a*.

The impeller 14 has a hub 22 which rotates integrally with the rotation axis 12, and a plurality of vanes 13 are provided on the outer periphery surface of the hub 22.

The hub 22 is made by injection molding using a typical resin material (a synthetic resin such as PBT, ABS and the like). At the molding, a magnetic yoke having a circular cross-section and being formed in a cup shaped outline which is closed at one end (upper end) side and opened at the other end (lower end) side, and is equipped with a rotor magnet 23 of the motor 15 on the inner periphery surface, and the rotation axis are placed in a molding die (not shown). Then, by injecting the resin material into the molding die, as shown in FIG. 1, a cylindrical portion 22*b* which is connected to and supported by the rotation axis 12 and is provided to extend in the axial direction of a disk shape ceiling portion 22*a* is provided, and a molded product of a circular cross-section and of a cup shaped outline which is closed at the upper end side and opened at the lower end side is formed. Further, at the same time, a plurality of vanes 13 are formed integrally on the outer periphery surface of the cylindrical portion 22*b* of the hub 22.

As shown in FIG. 1, the motor 15 is composed of a rotor 15*a* comprising a magnetic yoke 24 in the side of the impeller 14 and a rotor magnet 23 being mounted to the inner periphery side of the magnetic yoke 24, and a stator 15*b* being mounted and fixed to the outer periphery of the bearing housing 17 in the side of the casing 11. By rotating the rotor 15*a* to the stator 15*b*, the impeller 14 and the rotation axis 12 are rotated integrally.

As shown in FIG. 1, the stator 15*b* is mounted to the outer periphery surface of the bearing housing 17 from the side of the suction port 19*a*. The stator 15*b* is provided with an iron core 25 being fitted and mounted to the outer periphery of the bearing housing 17, and a driving coil 27 being wound to the iron core 25 through an insulator 26. In the lower portion of the stator 15*b*, a circuit board 28 for motor drive being packaged with electronic components for controlling a driving current supplied to the coil 27 is fixed and mounted to the insulator 26. The circuit board 28 is electrically connected to an external power source (not shown) through a lead wire (not shown too).

In the axial fan 10 having such a configuration, when a drive current is supplied to the coil 27 of the motor 15 from the circuit board 28, the rotor 15*a* operates and the rotation axis 12 and the impeller 14 rotates integrally. In addition, when the impeller 14 rotates, air or fluid is sucked into the inside of the plurality of vanes 13 of the impeller 14 from the suction port 19*a* of the casing 11, passes through the inside of casing 11, and is blown out to the outside of the casing 11 from the discharge port 19*b* of the casing 11. At this time, the plurality of spokes 20 being provided on the side of the discharge port 19*b* of the casing 11 rectify the air being blown out to the outside of the casing 11, and also increases the pressure of the air. As a result, in an electronic device such as a server and the like to which the axial fan is mounted, ventilation (or air circulation) is performed and internal cooling is performed.

Meanwhile, in an electronic device such as a server and the like, the inner space in which air flows is getting smaller, due to the high density packaging of the inside of the housing. Therefore, with regard to the axial fan 10 for cooling the inside of the above mentioned housing, the axial fan 10 being provided with high air volume and high static pressure is required. For this reason, in some cases, the motor 15 which rotates the impeller 14 is rotated at a maximum rotation speed up to 20000 rpm, in order to the axial fan 10 being provided with high air volume and high static pressure. When the motor 15 is rotated at a high speed, the accompanying vibration is transmitted to the casing 11 through the bearings 16*a*, 16*b*, and is transmitted to the electronic device being equipped with the axial fan 10, and as a result, vibration also generates in the electronic device. In this case, when the vibration caused by the rotation of the motor 15 resonates with the natural frequency of the casing 11, the vibration becomes even larger, as a result, there is a possibility that abnormal vibration occurs in the electronic device.

TABLE 1

| Example | No. of spokes | No. of ribs | Natural frequency of casing, Hz | Resonance rotation number of casing, rpm |
|---|---|---|---|---|
| Comparative Example 1 | 4 | 4 | approx. 252 | approx. 15095 |
| Comparative Example 2 | 6 | 6 | approx. 275 | approx. 16508 |
| Example 1 | 7 | 7 | approx. 365 | approx. 21910 |

In a case the number of the plurality of reinforcement ribs 21 and the number of the plurality of spokes are taken as a parameter, a value of the natural frequency (Hz) of the casing 11 estimated by an analysis and a resonance rotation speed of the motor 15 based on it are indicated in TAB. 1. Here, an estimated value D of natural frequency on a developed fan may be obtained by the following calculation formulas.

$$X=(B-A)/A$$

$$D=C/(1+X)$$

wherein A is a measured value of natural frequency on a referential fan, B is a simulated value of natural frequency on the referential fan, X is a parameter as shown in the above, and C is a simulated value of natural frequency on the developed fan.

In TAB. 1, the Comparative Example 1 represents the casing 11 where the number of the plurality of spokes 20 is formed to four and the number of the plurality of reinforcement ribs is formed to four too. The Comparative Example 2 represents the casing 11 where the number of the plurality of spokes 20 is formed to six and the number of the plurality of reinforcement ribs is formed to six too. Example 1 represents the casing 11 according to the embodiment of the present invention, as shown in FIG. 1 to FIG. 3, where the number of the plurality of spokes 20 is formed to seven and the number of the plurality of reinforcement ribs is formed to seven too. Meanwhile, the shape of the casing 11 is the same for all the Comparative Example 1, the Comparative Example 2, and the Example 1, each of the plurality of reinforcement ribs 21 is formed so as to mate at the connecting portion C where each of the plurality of spokes 20 is connected to the motor base 18.

As shown in TAB. 1, the natural frequency of the casing estimated by the analysis is approx. 252 Hz in Comparative Example 1, approx. 275 Hz in Comparative Example 2 and approx. 365 Hz in Example 1. Therefore, when the number of the plurality of reinforcement ribs 21 and the number of the plurality of spokes 20 are set to be equal, it can be seen that the natural frequency of the casing 11 increases with increasing number of the plurality of reinforcement ribs 21 and of the plurality of spokes 20. Here, in Example 1, a value of X (referred to as vibration frequency) in a case the maximum rotation speed of the motor 15 for rotating the impeller 14 of the axial fan 10 is assumed to 20000 rpm is calculated from the rotation speed ratio (365:X=21910: 20000) as 334. That is, it can be seen that the vibration frequency for the rotation of the motor 15 is approx. 334 Hz.

Therefore, if the natural frequency of the casing 11 estimated by the analysis in advance is lower than the vibration frequency of 334 Hz, there occurs a possibility that the frequency of the casing 11 associated with the rotation of the motor 15 and the natural frequency of the casing 11 resonate. As a result, there is a possibility that abnormal vibration is generated in the electronic device and the like.

Therefore, as shown in TAB. 1, with regard to the casings 11 in Comparative Example 1 and Comparative Example 2, the natural frequency of the casing 11 is 252 Hz and 275 Hz in turn, which are both lower than 334 Hz. Therefore, in the case the maximum rotation speed of the motor 15 for rotating the impeller 14 of the axial fan 10 is assumed to 20000 rpm, there is a possibility that the frequency of the casing 11 that occurs with this is to resonate with the natural frequency of the casing 11.

In contrast, the casing 11 of Example 1 shown in FIG. 1 to FIG. 3 shows the natural frequency (365 Hz) which is higher than 334 Hz. As a result, even if the maximum rotation speed of the motor 15 for rotating the impeller 14 of the axial fan 10 is assumed to 20000 rpm, it is possible to prevent generation of abnormal vibration in the electronic device and the like equipped with the axial fan 10, without generation of the resonance.

TABLE 2

| Casing | No. of spokes | No. of ribs | Natural frequency of casing, Hz | Resonance rotation number of casing, rpm |
|---|---|---|---|---|
| A | 7 | — | approx. 225 | approx. 13500 |
| B | 7 | 4 | approx. 308 | approx. 18480 |
| C | 7 | 5 | approx. 321 | approx. 19260 |
| D | 7 | 6 | approx. 337 | approx. 20220 |
| E | 7 | 7 | approx. 365 | approx. 21910 |
| F | 7 | 9 | approx. 369 | approx. 22140 |

Figure 4:
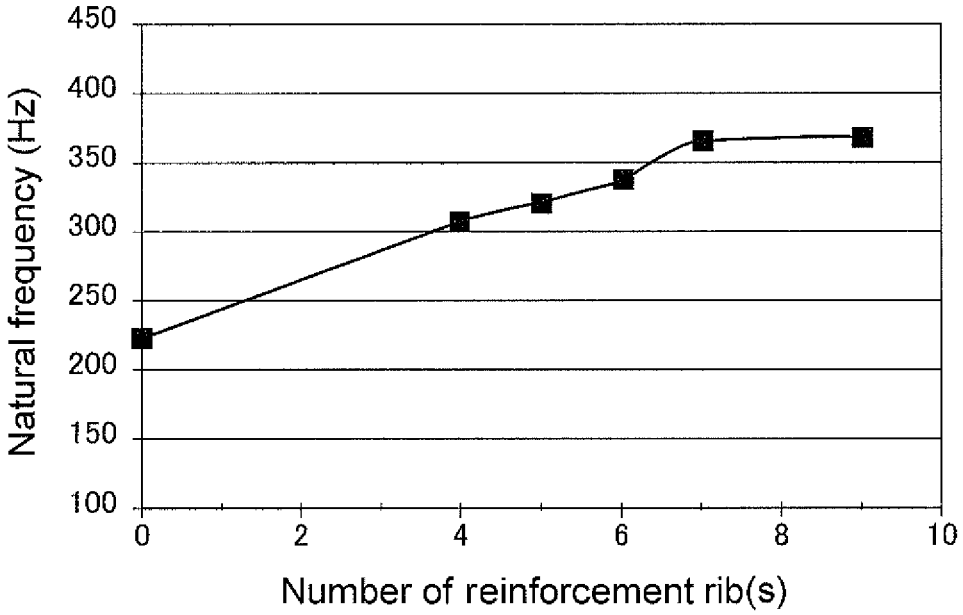
FIG. 4 is a graph showing a relationship between a number of the reinforcement ribs formed on the motor base and natural frequency of the housing.

TAB. 2 shows a natural frequency of the casing 11 estimated by the analysis and a resonance rotation speed of the motor 15 based thereon, when, in the casing 11 of the axial fan 10 (Example 1) of the embodiment shown in FIG. 1 to FIG. 3, the number of the plurality of spokes 20 is set to seven, and the number of the plurality of reinforcement ribs 21 formed on the motor base 18 is taken as a parameter. FIG. 4 is a graph showing the estimated natural frequency of the casing 11 when the number of the plurality of reinforcement ribs 21 shown in TAB. 2 is changed.

In TAB. 2, the number of the spokes 20 is seven and the reinforcement rib 21 is not formed in Casing A. The number of the spokes 20 is seven and the number of the reinforcement ribs 21 is formed to four in Casing B. The number of the spokes 20 is seven and the number of the reinforcement ribs 21 is formed to five in Casing C. The number of the spokes 20 is seven and the number of the reinforcement ribs 21 is formed to six in Casing D. The number of the spokes 20 is seven and the number of the reinforcement ribs 21 is formed to seven in Casing E (Example 1) which is the embodiment of the present invention shown in FIG. 1 to FIG. 3. The number of the spokes 20 is seven and the number of the reinforcement ribs 21 is formed to nine in Casing F. Meanwhile, all the casings have the same shape, and only in Casing E of Example 1 which is the embodiment of the present invention, each of the plurality of reinforcement ribs 21 is formed so as to mate at the connecting portion C where each of the plurality of spokes 20 is connected to the motor base 18.

As shown in TAB. 2 and FIG. 4, when the number of the spokes of the casing 11 is formed to seven, by forming the number of the reinforcement ribs 21 formed on the motor base 18 to a number being equal to or more than six, the natural frequency of the casting 11 can be set to a higher value (337 Hz) than the value of 334 Hz which is estimated by the analysis, even if the maximum rotation speed of the motor 15 for rotating the impeller of the axial fan 10 is 20000 rpm.

However, when the number of the reinforcement ribs 21 formed on the motor basement part 18 is six, it cannot be said that the margin is enough because the natural frequency of 337 Hz of the casing 11 is slightly higher than the vibration frequency of 334 Hz of the axial fan 10. For this reason, by forming the number of the reinforcement ribs 21 formed on the motor basement part 18 to a number being equal to or more than seven which is equal to the number of the spokes 20, the casing 11 having the natural frequency being equal to or higher than 365 Hz can be obtained with higher margin with regard to the vibration frequency of 334 Hz of the axial fan 10. As a result, when the number of the reinforcement ribs 21 formed on the motor basement part 18 is set to at least six, or more preferably to a number being equal to or more than seven, even if the maximum rotation speed of the motor 15 for rotating the impeller 14 of the axial fan 10 is 20000 rpm, the effect of the vibration transmitted to the casing 11 through the motor base 18 is lessened and so the abnormal vibration generating in the electronic devices equipped with the axial fan 10 can be prevented.

In addition, when the number of the reinforcement ribs 21 formed on the motor base 18 is the same with the number of the spokes 20, it is preferred that the reinforcement ribs 21 are formed so as to mate with the portion where the spokes 20 are connected to the motor base 18.

Meanwhile, although the description is made for a case where the number of the spokes 20 is seven in Example, it is enough that the number of the spokes 20 is equal to or more than seven. If the reinforcement ribs 21 is formed to seven or a number more than seven on the motor base 18 in a case the number of the spokes is formed to at least seven, when the maximum rotation speed of the motor 15 for rotating the impeller 14 is 20000 rpm, the natural frequency of the easing 11 grows higher than the frequency due to the vibration caused by the rotation of the motor 15, and so the occurrence of the abnormal vibration can be prevented.

Further, although the configuration is disclosed that the plurality of the reinforcement ribs 21 extend from the outer periphery side of the boss 18*a* to the outer periphery side of the motor base 18, in the same width W (in the circumferential direction) and the same height H (in the axial direction) (see FIGS. 3A and 3B), a configuration is possible that the plurality of the reinforcement ribs 21 extend such that the width H decreased gradually and the height H decreases gradually with increasing extension distance of the plurality of the reinforcement ribs 21 from the outer periphery side of the boss 18*a* to the outer periphery side of the motor base 18. In this way, by decreasing gradually the width of the reinforcement ribs 21 which is wide at the boss 18*a*, with extension distance toward the outer periphery side of motor base 18, the boss 18*a* can be strengthened effectively, excess reinforcement can be suppressed, and the weight of the casing 11 can be reduced.

In conclusion, according to the above configuration, the plurality of reinforcement ribs are provided radially on the motor base being formed in a disk shape in a plan view, while the plurality of the spokes connecting the motor base and the casing are provided, and as a result, the housing structure is strengthened. Moreover, a number of the plurality of reinforcement ribs is formed to be equal to or more than a number of the plurality of spokes, and, when the motor is rotated at a rotation speed of 20000 rpm or more, a natural frequency of the casing is set so as to be equal to or higher than a frequency being transmitted to the casing from the rotation of the motor. Thus, even if the motor is rotated at a rotation speed of 20000 rpm or more, the motor and the housing does not resonate, and as a result, occurrence of abnormal vibration in the housing can be suppressed.

Further, in a case the number of the plurality of the spokes is formed to be at least seven, if the number of the plurality of the reinforcement ribs is formed to be equal to or more than seven, the natural frequency of the casing grows higher than the frequency due to rotation of the motor at the maximum rotation speed of 20000 rpm or more, and so occurrence of abnormal vibration of the casing due to resonance of the motor and the casing can be prevented.

Furthermore, each of the plurality of spokes increases the air pressure blown to the outside of the casing, and acts as a fixed vane for rectifying the air exhaled.

Furthermore, the motor base is reinforced uniformly, by forming each of the plurality of the reinforcement ribs in an equal width to the outer periphery of the boss to the outer periphery side of the motor base, and occurrence of abnormal vibration can be prevented.

Furthermore, by gradually decreasing the width of each of the plurality of reinforcement ribs having a wider width at the boss, with extending distance from the outer periphery side of the boss to the outer periphery side of the motor base, it is possible to reinforce the boss efficiently, to suppress excess reinforcement, and to reduce the weight of the casing.

Furthermore, by providing each of the plurality of reinforcement ribs so as to extend toward the connecting portion of the plurality of spokes and the motor base, the strength of the connecting portion can be increased, and further, the overall structure of the casting can be strengthened.

It is noted that the present invention is not limited to the above described embodiment. A modification, an improvement and the like within the scope where the object of the present invention can be achieved are included in the present invention.

REFERENCE SIGNS LIST

10 . . . axial fan, 11 . . . casing, 12 . . . rotation axis, 13 . . . vane, 14 . . . impeller, 15 . . . motor, 15*a* . . . rotor, 15*b* . . . stator, 16*a*, 16*b* . . . bearing, 17 . . . bearing housing, 18 . . . motor base, 18*a* . . . boss, 19 . . . cavity portion, 19*a* . . . suction port, 19*b* . . . discharge port, 20 . . . spoke, 21 . . . reinforcement rib

The invention claimed is:

1. An axial fan comprising:
a shaft;
a plurality of vanes rotating with the shaft;
a motor configured to rotate the plurality of vanes and the shaft;
a casing;
a motor base disposed inside the casing;
a plurality of spokes connecting the motor base and the casing; and
a bearing supporting the shaft, wherein:
the motor includes a magnetic yoke formed in a cup shaped outline and a rotor magnet mounted to an inner periphery side of the magnetic yoke,
the motor base comprises a boss having a cylindrical shape and a plurality of reinforcement ribs coupling the boss and an outer peripheral edge of a surface of the motor base,
the boss protrudes from the surface of the motor base,
the boss supports the motor and the shaft via the bearing,
the plurality of reinforcement ribs overlap the bearing along a radial direction, and
an end portion of the shaft overlaps the plurality of reinforcement ribs or the surface of the motor base along the radial direction.

2. The axial fan according to claim 1, wherein the motor base comprises a disk shape.

3. The axial fan according to claim 1, wherein the plurality of spokes is coupled to the outer peripheral face of the motor base.

4. The axial fan according to claim 1, wherein the plurality of reinforcement ribs is more than the plurality of spokes in number.

5. The axial fan according to claim 1, wherein the motor is capable of rotating at a rotation speed from 20220 rpm to 22140 rpm thereby creating a resonance in the casing.

6. The axial fan according to claim 1, wherein the plurality of reinforcement ribs extends from an outer peripheral face of the boss.

7. The axial fan according to claim 1, wherein an end of the shaft oriented closest to the boss is arranged outside with respect to a position coupling the boss and at least one of the reinforcement ribs in a rotation axis direction.

8. The axial fan according to claim 1, wherein the motor comprises a stator and a circuit board coupled to a part of the stator in the motor base side, and wherein the circuit board is arranged inside with respect to the reinforcement ribs in a rotation axis direction.

9. The axial fan according to claim 1, wherein the bearing faces the reinforcement ribs in the radial direction.

10. The axial fan according to claim 1, wherein a width of one of the reinforcement ribs at the boss side with respect to an outer peripheral edge of the motor base is larger than a width of the one reinforcement rib at the outer peripheral edge side with respect to the boss in a circumferential direction.

11. An axial fan comprising:
a shaft;
a plurality of vanes rotating with the shaft;
a motor configured to rotate the plurality of vanes and the shaft;
a casing;
a motor base disposed inside the casing;
a plurality of spokes connecting the motor base and the casing; and
a bearing supporting the shaft,
wherein:
the motor includes a magnetic yoke formed in a cup shaped outline and a rotor magnet mounted to an inner periphery side of the magnetic yoke,
the motor base comprises a boss having a cylindrical shape and a plurality of reinforcement ribs coupling the boss and an outer peripheral edge of a surface of the motor base,
the boss supports the motor and the shaft via the bearing,
the plurality of reinforcement ribs overlap the bearing along a radial direction, an end portion of the shaft overlaps the plurality of reinforcement ribs or the surface of the motor base along the radial direction, and the reinforcement ribs face the shaft in the radial direction.

12. The axial fan according to claim 11, wherein the bearing faces the reinforcement ribs in the radial direction.

13. The axial fan according to claim 11, wherein a part of the boss coupling the reinforcement ribs faces the shaft.

14. The axial fan according to claim 11, wherein the motor comprises a stator and a circuit board coupled to a part of the stator in the motor base side, and wherein the circuit board is arranged inside with respect to the reinforcement ribs.

15. The axial fan according to claim 11, wherein the motor base comprises a disk shape.

16. The axial fan according to claim 11, wherein the plurality of spokes is coupled to an outer peripheral face of the motor base.

17. The axial fan according to claim 11, wherein the plurality of reinforcement ribs is more than the plurality of spokes in number.

18. The axial fan according to claim 11, wherein the motor is capable of rotating at a range of a rotation speed from 20220 rpm to 22140 rpm thereby creating a resonance in the casing.

19. The axial fan according to claim 11, wherein the plurality of reinforcement ribs extend from an outer peripheral face of the boss.

20. The axial fan according to claim 11, wherein a width of one of the reinforcement ribs at the boss side with respect to an outer peripheral edge of the motor base is larger than a width of the one reinforcement rib at the outer peripheral edge side with respect to the boss in a circumferential direction.

* * * * *